US005507076A

United States Patent [19]

Anscher

[11] Patent Number: 5,507,076

[45] Date of Patent: Apr. 16, 1996

[54] SIDE-RELEASE BUCKLE HAVING IMPROVED LOCKING FEATURE

[75] Inventor: Joseph Anscher, Muttontown, N.Y.

[73] Assignee: National Molding Corporation, Farmingdale, N.Y.

[21] Appl. No.: 306,355

[22] Filed: Sep. 15, 1994

[51] Int. Cl.[6] ..... A44B 11/00

[52] U.S. Cl. ..... 24/625; 24/616; 24/630

[58] Field of Search ..... 24/625, 614, 615, 24/616, 647, 597, 632, 630, 629

[56] References Cited

U.S. PATENT DOCUMENTS

| | | | |
|---|---|---|---|
| 1,737,246 | 11/1929 | Jones | 24/625 |
| 4,150,464 | 4/1979 | Tracy | 24/615 |
| 4,672,725 | 6/1987 | Kasai | 24/625 |
| 5,131,122 | 7/1992 | Lavato | 24/625 |
| 5,222,279 | 6/1993 | Frano et al. | 24/625 |
| 5,237,728 | 8/1993 | Fudaki | 24/625 |

FOREIGN PATENT DOCUMENTS 2262962 7/1993 United Kingdom .

*Primary Examiner*—Victor N. Sakran
*Attorney, Agent, or Firm*—Kenyon & Kenyon

[57] ABSTRACT

A side release buckle having an improved locking mechanism includes a male plug member and a female socket member. The plug member has a pair of resiliently flexible arm members. Each arm member includes a recess or notch disposed along the central longitudinal axis of the arm member which is adapted to engage a tooth arranged in a corresponding position in the socket member when the plug member is fully inserted into the socket member. Since the engagement or retaining force between the recess and the tooth lies along the central longitudinal axis of the arm members, this force directly opposes the load force on the buckle which acts to separate the two buckle pieces. Because of the proper positioning and arrangement of the recess and the tooth, the load force and the retaining force are aligned along the same axis, thereby providing increased holding power.

19 Claims, 5 Drawing Sheets

SIDE-RELEASE BUCKLE HAVING IMPROVED LOCKING FEATURE

BACKGROUND OF THE INVENTION

1. Field of the Invention

The invention relates generally to side-release buckles of the type having a female receptacle member and a mating male latch member which are releasably lockable together. More particularly, the invention relates to such a side-release buckle wherein the female receptacle member includes a tooth which is adapted to engage with a centrally aligned groove and latch in a leg of the male latch member, whereby the latch and tooth provide a resistance force in opposition to and in central alignment with a loading force acting to separate the male latch member from the female receptacle member.

2. Description of Related Art

Assorted two-piece buckles are known in the art. These buckles typically include a female receptacle or socket member which is engageable with a male latch or plug member. One or both of the members adjustably or fixedly holds a strap or belt around crossbars or the like. One particularly common form of a two-piece buckle is one in which the plug member includes a pair of legs which, when inserted into the socket member, flex inwardly and slide past opposing stop members (e.g., latches) in the socket until they snap fit into respective side openings in the socket. The stop members are typically inwardly projecting surfaces of the socket member around the periphery of the opening which engage with shoulders defined on the outside edges of the legs of the male member. The two buckle pieces are unlocked and disengaged by squeezing the legs of the male member through the openings in the female member between the thumb and forefinger, thereby freeing the shoulders defined in the legs from the respective stop members in the female member and allowing the two buckle pieces to become separated.

An example of such a buckle is disclosed in U.S. Pat. No. 4,150,464, and a basic configuration of this type of buckle is illustrated in FIGS. 3 and 4. It can be seen that the female member defines apertures in opposing side walls thereof for engagement with shoulders of the latch arms belonging to the male member. The shoulders are positioned on the outside side surfaces of the latch arms and engage the stop members which project inwardly from the side walls of the female member. However, it has been recognized that with this arrangement, the buckle is susceptible to failure during heavy loading for the following reasons. The load in the latch arms which urges removal of the latch arms from the female member is ordinarily directed along the longitudinal axis or center line X of each latch arm. However, the line Y, which represents the location of the latch resistance or engagement force opposing the load, is offset from center line X because it is directed between the side walls of the female member and the shoulders on the outside side surfaces of the latch arms. Accordingly, it has been recognized that during loading on the buckle, a torque develops between the latch arms and the female member which tends to cause inward rotation of the latch arms in the direction of arrow Z (see FIG. 4), and consequently release of the buckle (see also U.S. Pat. No. 5,222,279 (col. 1, 1. 43–48).

U.S. Pat. No. 5,222,279 proposes a solution to this problem. In accordance with this patent, the shoulders on the latch arms are relocated from the outside side surfaces thereof to the top and bottom surface of each arm (see FIGS. 1 and 2). Thus, each arm has a pair of shoulders on opposite top and bottom sides of the arm (i.e., the top and bottom of the arm), and the shoulders are on opposite sides of the longitudinal axis or central line of each latch arm. The shoulders engage corresponding stop members in the female member of the buckle. Since the shoulders are no longer positioned on the outside side surfaces of the latch arms, and since the shoulders are aligned, in one direction, with the central or longitudinal axis of the latch arms, the latch resistance force which opposes the load on the buckle is aligned, in one direction, with the load force.

However, since the shoulders on the latch arms of the buckle described in U.S. Pat. No. 5,222,279 are located on opposite sides (i.e., the top and bottom) of the longitudinal axis of the latch arm, the latch resistance force opposing the load is merely aligned in one direction (i.e., in the "width" direction) with the load force. The latch resistance force is not aligned with the longitudinal or central axis of the latch arms in all planes and directions.

Published U.K. Patent Application GB 2 262 962 also proposes a solution to the problem of misalignment of the latch resistance or engagement force with the load force which occurs in the prior art buckles wherein the shoulders are defined in the outside side surfaces of the latch arms. The proposed solution is similar to the one described in U.S. Pat. No. 5,222,279 in that it involves the provision of engagement shoulders on the top and bottom surfaces of the latch arms. The engagement shoulders or surfaces on the latch arms are grooves which are adapted to mate with corresponding ridges in the female member of the buckle. The engagement or latch resistance force between the grooves on the latch arms and the ridges in the female member is aligned, in one direction, with the longitudinal or center axis of the latch arms. However, like the buckle described in U.S. Pat. No. 5,222,279, the latch resistance force is not aligned along the longitudinal axis of the latch arms in all directions, but rather it is located on opposite (i.e., top and bottom) surfaces of the latch arms.

It would therefore be desirable to provide a side-release buckle wherein the engagement force between the male and female members, which opposes the load force, is aligned in all directions with the longitudinal or central axis of the latch arms belonging to the male member, rather than being aligned merely in one direction, in order to further improve the locking strength of the buckle.

SUMMARY OF THE INVENTION

Accordingly, it is an object of the invention to provide a side-release buckle wherein the engagement force between the male and female members of the buckle, opposing the load force, is aligned in all directions with the longitudinal or central axis of the arms belonging to the male member of the buckle.

It is a further object of the invention to provide a side-release buckle having an improved locking mechanism as compared to the side-release buckles of the prior art.

These and other objects of the invention, which will become apparent from the following Detailed Description of the Invention, are achieved by a side-release buckle having the following structure.

The invention is a side-release type buckle having a female socket member which defines a socket or receptacle therein having an open end. A male latch or plug member having at least one arm for insertion into the socket through the open end of the female member is provided. The plug member includes at least one resiliently flexible arm projecting from a base thereof which is adapted to be inserted into the socket member. A region at or near the distal end of the arm(s) defines a rounded protrusion on the outside side surface of the arm. The rounded protrusion defines a groove along a center line thereof, the groove being aligned in one direction with the longitudinal axis of the arm. The groove includes a proximal notch or recess which is deeper than the remaining distal portion of the groove so as to define a shoulder in the arm located on the central, longitudinal axis of the arm.

The female socket member includes at least one aperture defined through a side wall thereof for exposing the rounded protrusion of the arm belonging to the plug member, when the plug member is fully inserted into the socket member. An inner surface of the side wall of the socket member, adjacent to or near the distal end of the aperture defined in the side wall, includes an inwardly projecting tooth which is adapted to engage with the shoulder defined in the arm of the male member as follows. The tooth includes a ramp surface on its distal side to permit the groove defined in the rounded protrusion of the arm belonging to the male member to slide over it. As the male member is inserted into the socket, its resilient arm will flex inwardly as the groove slides over the ramp surface of the tooth until the shoulder defined in the arm clears the proximal side of the tooth. At this point, the arm will snap back outward through the aperture in the side wall of the socket member. In this position, the proximal face of the tooth will abut the shoulder defined in the arm of the plug member thereby locking the two buckle pieces together. Since the tooth and the shoulder are now aligned along the central, longitudinal axis of the arm, it will be appreciated that the engagement force, which opposes the load force on the buckle, is aligned along the same axis with the load force so that the two forces oppose each other by 180°.

If desired, the aperture defined in the side wall of the socket member may also include a conventional stop member at the distal end of the opening and the rounded protrusion of the arm may also include a conventional shoulder defined along its outside side surface for engagement with the stop member for additional holding strength.

To separate the two buckle pieces, the rounded protrusion of the arm is merely pushed into the aperture in the side wall of the socket until the shoulder clears the tooth. The resilient force now supplied by the arm will urge the plug member to spring out of the socket member, thereby disengaging the buckle pieces.

In another embodiment, the disengagement means (e.g., the rounded protrusion belonging to the arm which can be pushed into the aperture in the side wall of the socket) is provided on the socket member rather than the plug member. In this embodiment, the plug member still includes a centrally disposed groove aligned along the center line of the arm and a shoulder defined in said groove, however, the arm does not include any protrusion portion which projects out of the side wall of the socket member. Instead, the socket member includes at least one resiliently flexible arm in its side wall which can be pushed inward through an aperture in the side wall to force the arm belonging to the plug member inward and away from the tooth. The tooth which projects from an inner surface of the side wall of the socket member engages and disengages from the shoulder defined in the arm belonging to the plug member as in the other embodiment.

BRIEF DESCRIPTION OF THE DRAWINGS

Various other objects, features and advantages of the present invention will be more fully appreciated from the following detailed description of the preferred embodiments, when considered in connection with the accompanying drawings, in which like reference characters designate like or corresponding parts throughout the several views, and wherein.

DETAILED DESCRIPTION OF THE INVENTION

Figure 1:
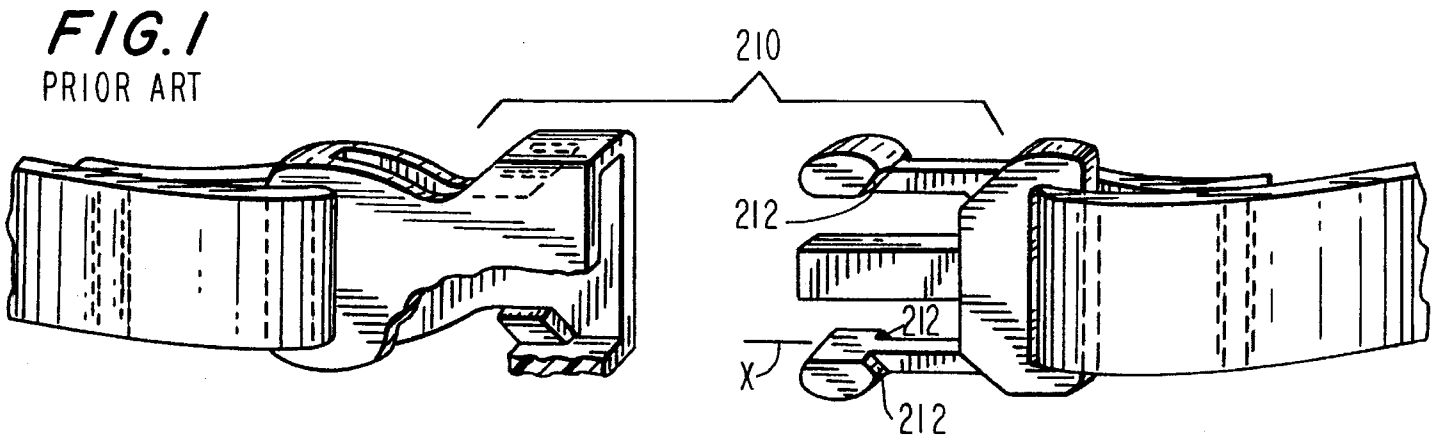
FIG. 1 PRIOR ART
FIG. 1 is an exploded perspective view of a side release type buckle of the prior art showing the male and female members separated.

Referring to FIGS. 5–9, a buckle in accordance with a first embodiment of the invention is designated generally by the reference numeral 1. The buckle 1 is typically used to connect free-ends of straps 2 and 3 (see FIG. 6). The buckle 1 is generally comprised of two pieces, a female socket member 4 and a complementary male plug member 5.

The buckle 1 is preferably molded from some type of plastic or resin, but any suitable material known in the art for molding or machining side-release type buckles may be used.

The socket member 4 includes a single cross bar 6 at its proximal end. The strap 2 is looped around the cross bar 6 and then stitched to itself to permanently secure the strap to the cross bar. The male plug member 5 includes a pair of cross bars 8 and 9 at its proximal end which can receive the strap 3 in a well known manner such that the strap 3 is adjustable, for example, as described in my U.S. Pat. No. 5,216,786. Alternatively, the pair of cross bars may be provided on the female socket member and the single cross bar may be provided on the male member, or both the male and the female members may include a single cross bar, in which event both strap 2 and strap 3 would not be adjustable.

Figure 5:
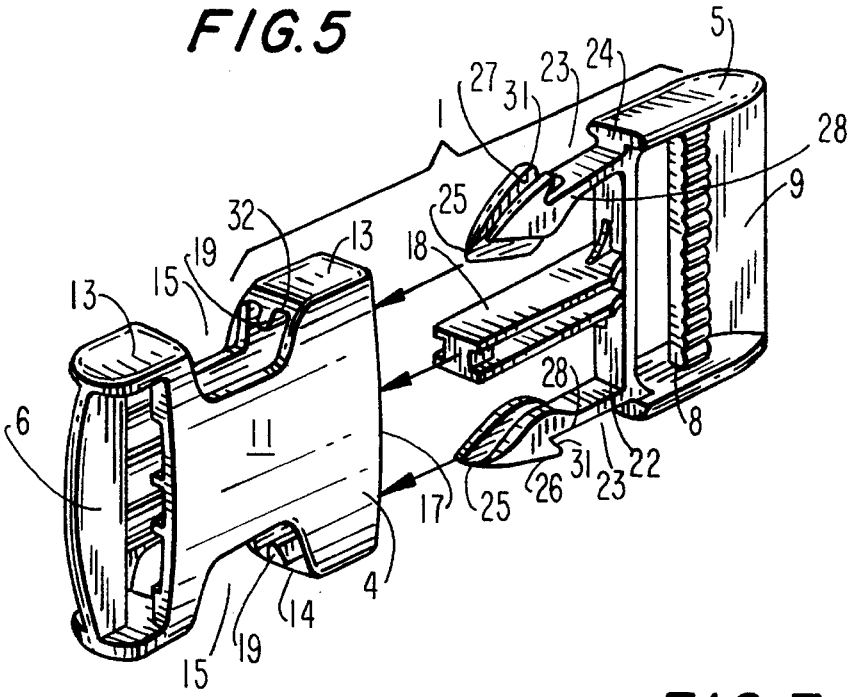
FIG. 5 is an exploded perspective view of a first embodiment of a buckle in accordance with the invention.
Figure 7:
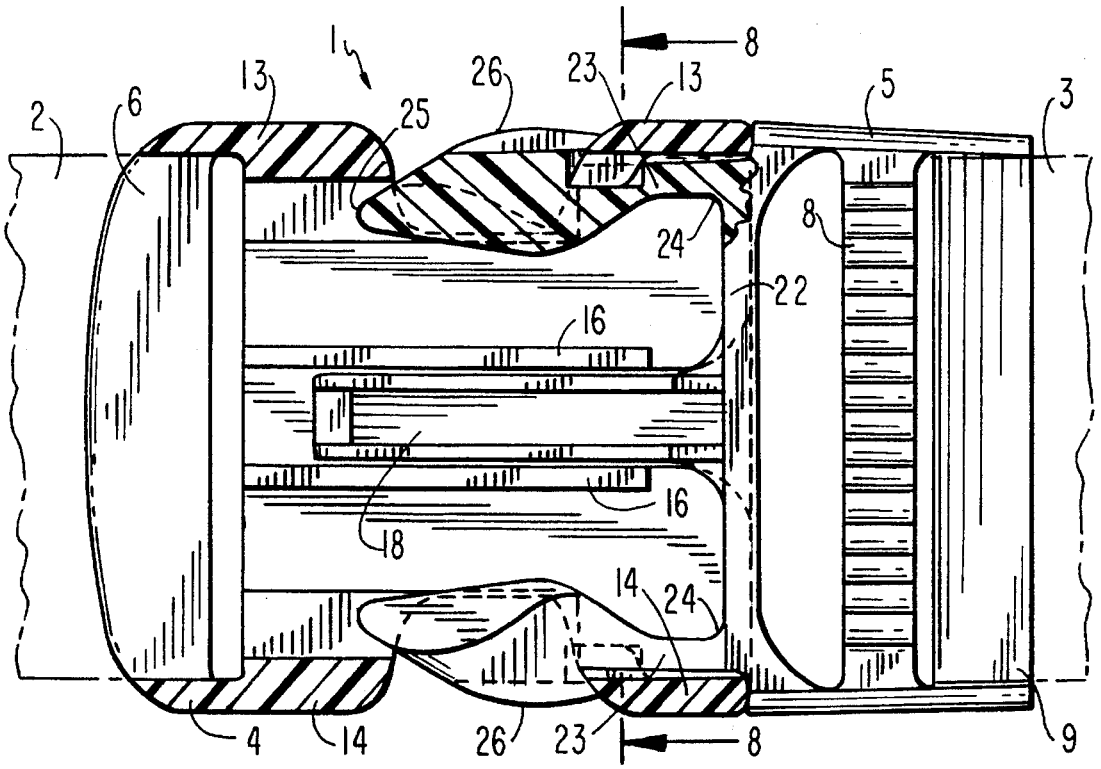
FIG. 7 is a bottom cross-sectional view of the buckle of FIG. 6 taken along the line 7—7.
Figure 8:
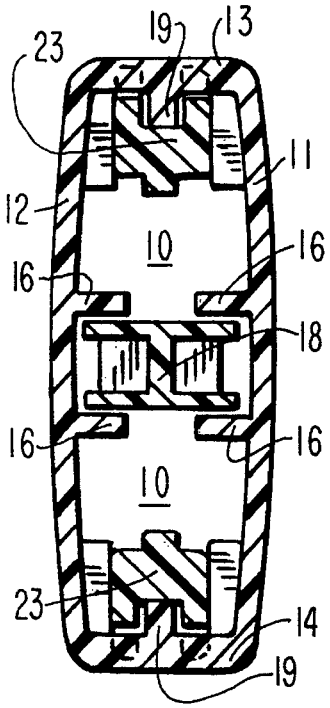
FIG. 8 is a cross-sectional view of the of the buckle illustrated in FIG. 7 taken along the line 8—8.

The socket member 4 preferably has a flat rectangular tubular cross-sectional configuration as illustrated in FIG. 5, having a substantially rectangular shaped interior cavity 10 (see FIG. 8). The cavity 10 is defined as the area between a top wall 11, an opposing bottom wall 12 and a pair of side walls 13 and 14, each of which connects the top wall to the bottom wall at the side edges thereof. The top and bottom walls 11 and 12 are typically much wider than the side walls 13 and 14, as illustrated, so that the socket member has a substantially flat or rectangular shape.

As will be explained in detail below, the male plug member 5 is received and releasably locked within the cavity 10 of the female socket member 4 via latch means which are associated with the male member. The female socket member 4 includes an aperture 15 defined in each side wall 13 and 14 thereof. The apertures 15 cooperate with the latch means associated with the male plug member 5 to retain and lock the plug member 5 within the socket member 4. The apertures 15 also enable the user to access the male plug member 5 from the exterior of the socket member 4 to allow for release of the two buckle pieces (see FIGS. 7 and 9). Each aperture 15 extends at least through a portion of the top and bottom walls 11 and 12, as well as through the opposing side walls 13 and 14, to form a side-release type buckle 1. However, as will be appreciated by those skilled in the art, the particular shape, location, position and number of apertures 15 can vary so long as the side-release buckle 1 functions substantially as described herein.

To facilitate in guiding the male plug member 5 as it is inserted into the cavity 10 of the socket member 4, the inner surfaces of the top and bottom walls 11 and 12 of the socket member 4 may be formed with a pair of inwardly projecting guides 16 (see FIG. 8) which extend from the distal end 17 (i.e., the open end) of the socket member toward the proximal end near the cross bar 6. The area between the guides 16 will receive a distally projecting and centrally disposed guide bar 18 on the male plug member 5 as will be described hereinafter.

To retain and lock the plug member 5 in the socket member 4, the inner surface of each side wall 13 and 14 of the socket 4 includes an inwardly projecting tooth 19. Each tooth 19 is positioned along the inner surface of the side wall 13 or 14 to which it belongs substantially along the central longitudinal axis of the side wall, which is the midway line between the top wall 11 and the bottom wall 12. Each tooth 19 includes a proximal surface 20 (see FIG. 9) which projects inwardly from the inner surface of its associated side wall toward the interior of the cavity 10. Each tooth 19 also includes a ramped surface 21 which extends from a tip in the distal direction toward the inner surface of the side wall to which the tooth is attached to eventually merge with the inner surface of said side wall. Each tooth 19 is positioned adjacent to or near the distal end of the aperture 15 in the side wall 13 or 14.

The male plug member 5 includes a proximal base portion 22 which is attached to two resiliently flexible arm members 23. Arm members 23 project in the distal direction from the base 22. The pair of arm members 23 have a predetermined length, and run along opposite sides of the male plug member 5. Guide bar 18 (if provided) also projects in the distal direction from the base 22.

Each arm member 23 includes a first proximal end 24 which is attached to the base portion 22 and a second opposite distal end 25. To facilitate access to the user of the buckle, the distal end 25 of each arm member 23 is formed with a rounded protrusion or bulbous region 26 on its outer side surface. A groove 27 is cut into the outside side surface of the protrusion 26 from the distal end 25 (see FIGS. 5 and 6). The groove 27 is aligned in one direction along the central longitudinal axis of the arm member 23 (i.e., the midway line between the top surface 28 and the bottom surface 29 of each arm member) (see FIG. 6). The groove 27 is of a size to enable it to receive the tooth 19 when the plug member 5 is inserted into the cavity 10 of the socket member 4.

Each groove 27 is formed with a notch 30 (see FIG. 9) at some point proximal to the distal end 25 of the arm 23. The notch 30 is deeper than the groove 27 so as to define a locking shoulder in the arm with which the locking surface 20 of the tooth 19 is adapted to engage. The notch 30 should be positioned along the arm 23 at a predetermined point such that it engages the tooth 19 when the plug member 5 is fully inserted into the socket member 4. Preferably, the notch 30 is deep enough to extend through the central longitudinal axis of the arm member 23 to which it belongs. The notch 30 may go deep enough to extend completely through the arm 23 all the way to the inner side surface of the arm to form a hole. The notch 30 may also be extended proximally along the outside side surface of arm 23 all the way to the proximal end 24 to define a channel (or slot if the notch goes all the way through the arm to the inner side surface thereof), if desired for ease of molding. Thus, it is to be understood that the term "notch" used herein means any recessed area defining a shoulder, including a depression, a hole, a channel, a slot, etc. . . .

To releasably connect the male plug member 5 to the socket member 4, the distal end 25 of each arm member 23 is first inserted within the cavity 10, with the guide bar 18 being positioned within the guides 16 of the socket member 4. Upon continued insertion, the distal ends 25 and grooves 27 will contact the ramped surface 21 of each tooth 19, and each arm member 23 will be flexed toward the interior of the cavity 10. Further insertion will result in the ramped surface 21 to ride along the groove 27 until the proximal locking surface 20 of the tooth 19 reaches the notch 30, at which point each arm member 23 snaps outward with respect to the cavity 10 so that the tooth 19 sits inside the notch 30. In this position, the proximal locking surface 20 of the tooth 19 will abut the shoulder defined by the notch 30 to lock the plug member 5 to the socket member 4 (see FIGS. 6 and 7). It can be seen from FIG. 7 that in this locked position, the rounded protrusions 26 extend out from the sides of the socket member through the apertures 15.

Figure 9:
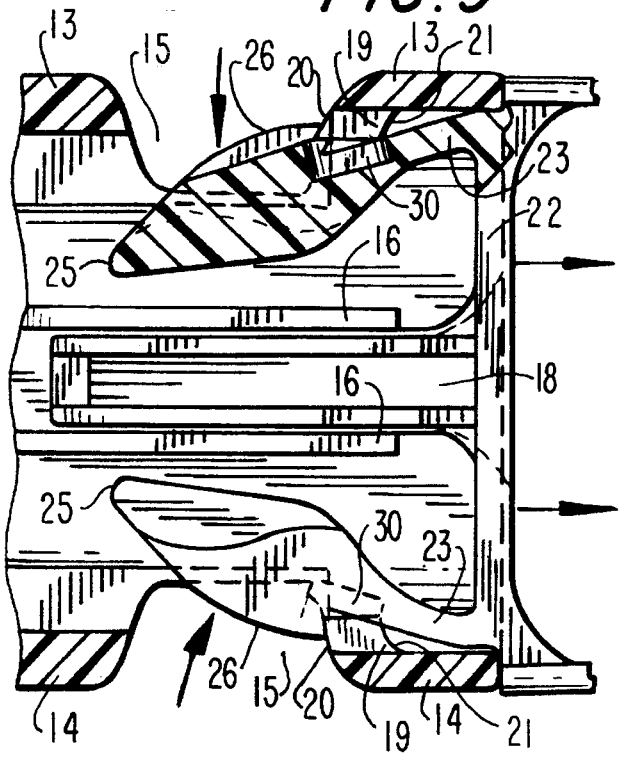
FIG. 9 is an isolated view of the buckle illustrated in FIG. 7 showing disengagement of the locking mechanism.
Figure 10:
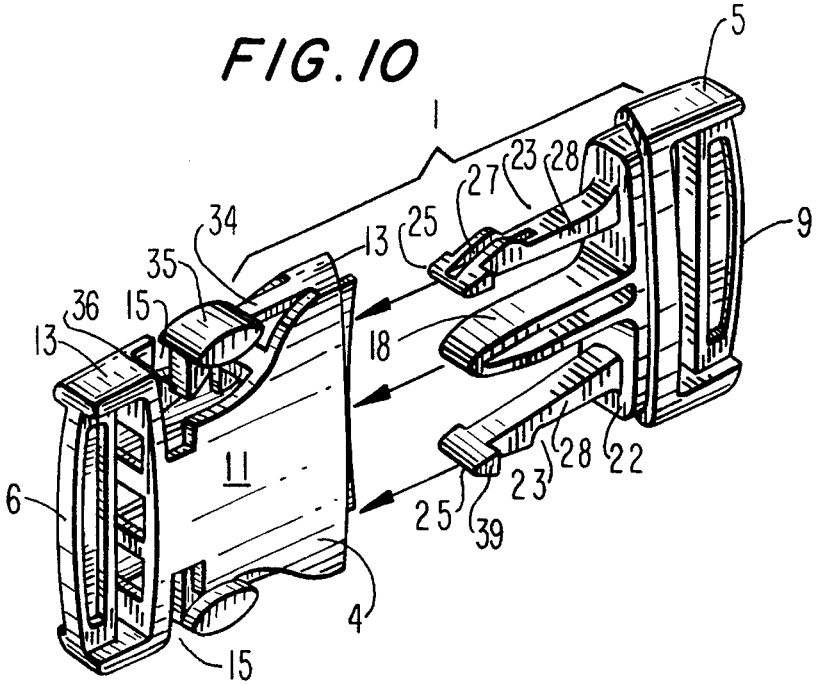
FIG. 10 is an exploded perspective view of a buckle in accordance with a second embodiment of the invention.

As FIG. 9 illustrates, to release the male plug member from the cavity 10, a user presses the protrusions 26 into the cavity to flex the arm members 23 inward with respect to the cavity 10. Once the shoulders defined by the notches 30 clear the locking surfaces 20 of the teeth 19, the male plug member can be removed from the socket member. The resilient force exerted by the arm members so flexed inwardly will facilitate the "springing out" of the plug member from the cavity 10. In addition, the rounded outside side surfaces of the protrusions 26 will also facilitate easy separation of the plug member 5 from the socket member 4.

Figure 3:
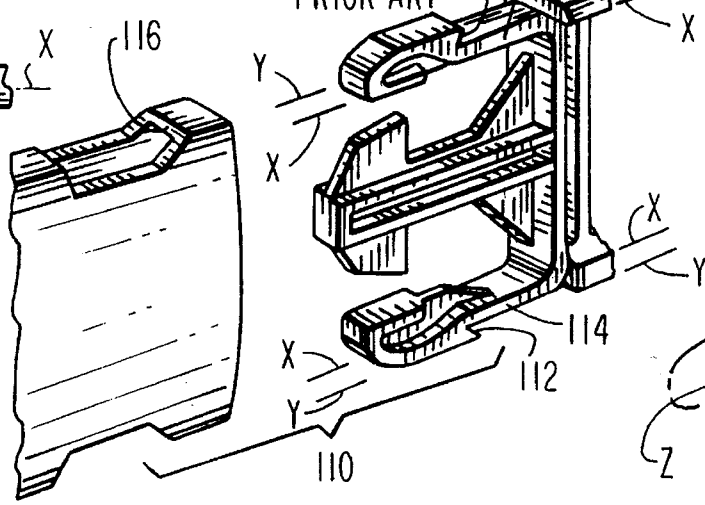
FIG. 3 PRIOR ART
FIG. 3 is an exploded perspective view of another prior art buckle showing the female and male members separated.
Figure 4:
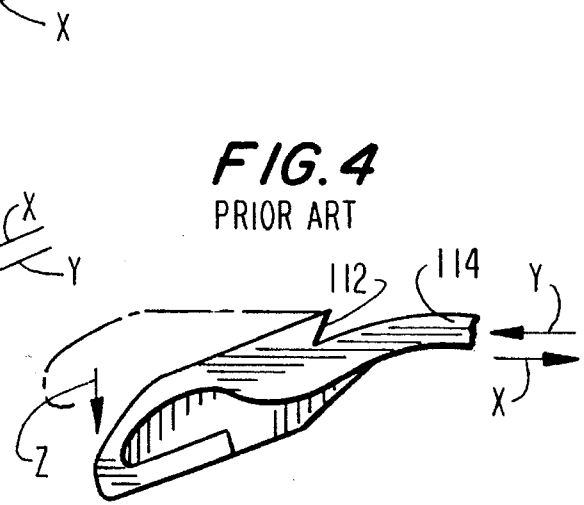
FIG. 4 PRIOR ART
FIG. 4 is an enlarged isolated view of a portion of the prior art buckle of FIG. 3, illustrating the engagement and failure positions between the male and female members.

As described earlier, the prior art buckle 110 illustrated in FIGS. 3 and 4 includes shoulders 112 located on the outer side edges of the arm members 114 of the male latch member. Accordingly, the force provided under load is centered along line "X", which runs through the longitudinal center line or axis of each arm member 114, while the engagement or retaining force provided by the shoulders 112 is centered along line "Y", which runs through the shoulders 112 and is slightly offset from the line "X". The offset between lines "X" and "Y" produces a torque on the arm members 114 substantially in the direction of arrow "Z" in FIG. 4 causing premature unlocking of the arm members 112 from the stop members 116 and/or release of the buckle 110.

Figure 2:
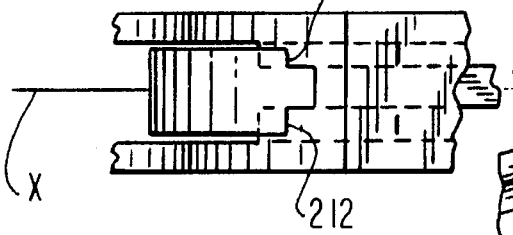
FIG. 2 PRIOR ART
FIG. 2 is an isolated enlarged side elevational view of the locking mechanism of the prior art buckle of FIG. 1 wherein the male and female members are coupled.

As described earlier, the buckle 210 of U.S. Pat. No. 5,222,279 (illustrated in FIGS. 1 and 2) does not provide a complete solution to this problem, because the shoulders 212 which supply the engagement or retaining force are aligned with the longitudinal axis "X" of the arm member only in one direction (i.e., referred to in the prior art patent as the "width" direction). The retaining force is not aligned in all directions because the shoulders are located on the top and bottom of each arm member (see FIGS. 1 and 2) (i.e., on opposite sides of the central longitudinal axis in the other direction).

Figure 6:
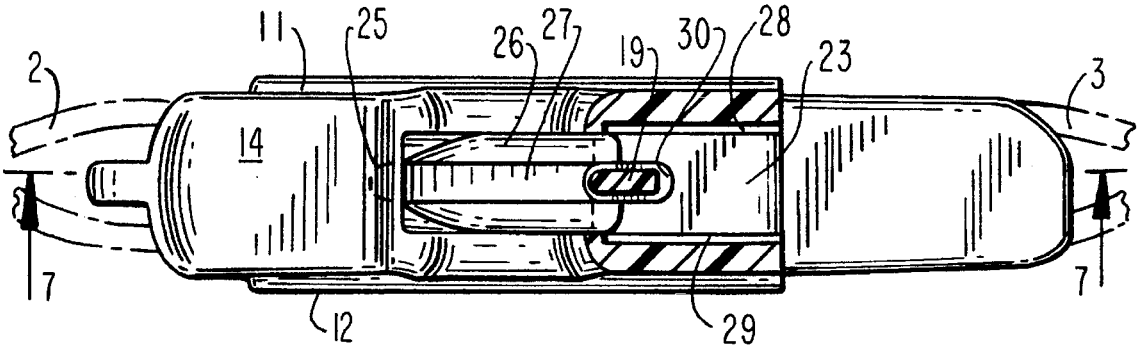
FIG. 6 is an elevational view of a side of the buckle of FIG. 5 in the coupled or locked state which is partially cut away to expose the locking mechanism.

In contrast, as FIGS. 5, 6 and 8 illustrate, the buckle 1 of the present invention provides alignment of both the load force through the longitudinal center line or axis of each arm member 23 and the engagement or retaining force provided by the engagement of the shoulder in the notch 30 with the proximal surface 20 of tooth 19. This alignment of forces in all directions is possible due to the central positioning of the notch 30 along the longitudinal axis of the arm member 23 midway between the top surface 28 and the bottom surface 29, see FIG. 6, as well as midway between the outer side surface and the inner side surface) and the corresponding central positioning of the tooth 19 along the midway line of the side wall between the top wall 11 and bottom wall 12 of the socket member 4.

For additional strength, the buckle 1 of this first embodiment of the invention may also be provided with a conventional releasable locking means for two-piece side release buckles. For this purpose, the proximal end of each of the rounded protrusions 26 defines a conventional shoulder 31 (see FIG. 5) on the outer side surface of each arm member 23. A complementary stop member 32 is provided at the distal end of each aperture 15 in the socket member 4. It can be seen that each stop member 32 is simply an extension of the side wall 13 or 14 which projects inwardly toward the cavity 10. As known in the art, the locations of the shoulder 31 and stop member 32, as well as the dimensions of the various features of the buckle are predetermined such that shoulders 31 abut against stop members 32 when the arm members 23 are fully inserted into the socket member 4. Of course, in this locked position, the proximal locking surface 20 of the tooth 19 will abut against the shoulder defined by notch 30. Unlocking of the buckle occurs in the same manner described above - - - the user merely squeezes the rounded protrusions 26 toward the interior of the cavity 10 until the shoulders 31 clear the stop members 32 and the notches 30 clear the teeth 19, whereupon the resilient force exerted by the inwardly flexed legs, in cooperation with the rounded surfaces of the protrusions 26, will urge the plug member to spring out of the cavity 10.

It can be seen that in the first embodiment of the invention, the user must have access to the rounded protrusions 26 through the apertures 15 in order to release the buckle and separate the two buckle pieces. In a second embodiment of the invention, the disengagement means is provided exclusively on the socket member 4 rather than on the plug member 5. The second embodiment is illustrated in FIGS. 10–15 in which like reference numerals designate like or corresponding parts which are present in the first embodiment.

It can be seen that in the second embodiment, no portion of the arm members 23 project out from the openings 15 in the side walls 13 and 14 of the socket member 4. Rather, the socket member 4 includes a pair of pivotable releasing members 33 formed in opposite sides 13 and 14, respectively. Each releasing member 33 includes a stem portion 34 and a head portion 35. The distal end of the stem portion 34 is attached to side wall 13 or 14 as the case may be, and the releasing member 33 is pivotable about this point of attachment through aperture 15 in each side wall. The head 35 of each releasing member 33 includes an inwardly projecting finger 36 which projects inwardly toward cavity 10.

A bridge 37 extends across each aperture 15 between the top wall 11 and the bottom wall 12 of the socket member 4. Bridge 37 is positioned inwardly of releasing member 33 so that releasing member 33 remains pivotable over the bridge 37. The purpose of the bridge is to support tooth 19 which, as will be described below, is adapted to lock into the notch 30 (see FIG. 15) of arm member 23 when the plug member 5 is fully inserted into the socket member 4. As in the previous embodiment, the tooth 19 includes a locking surface 20 on its proximal face and a ramped surface 21 on its distal face.

As in the first embodiment, the outer side surface of each arm member 23 has a centrally disposed groove 27 extending from the distal end 25 of the arm in a proximal direction toward a notch 30. The groove 27 lies along the midway line on the outer side surface between the top surface 28 and the bottom surface 29 (see FIGS. 11 and 14). The notch 30 is deeper than the groove 27, and preferably is deep enough to extend through the central longitudinal axis of the arm member 23 (i.e., the midway line between the inner side surface and the outer side surface, as well as the midway line between the top surface 28 and the bottom surface 29 of arm member 23). The groove 27 is adapted to slidably receive the ramped surface 21 of the tooth 19 in the socket member 4. As in the previous embodiment, the notch 30 defines a shoulder 38 (see FIG. 15) inside the arm member 23 which is adapted to engage with the locking surface 20 on the tooth 19.

Figure 12:
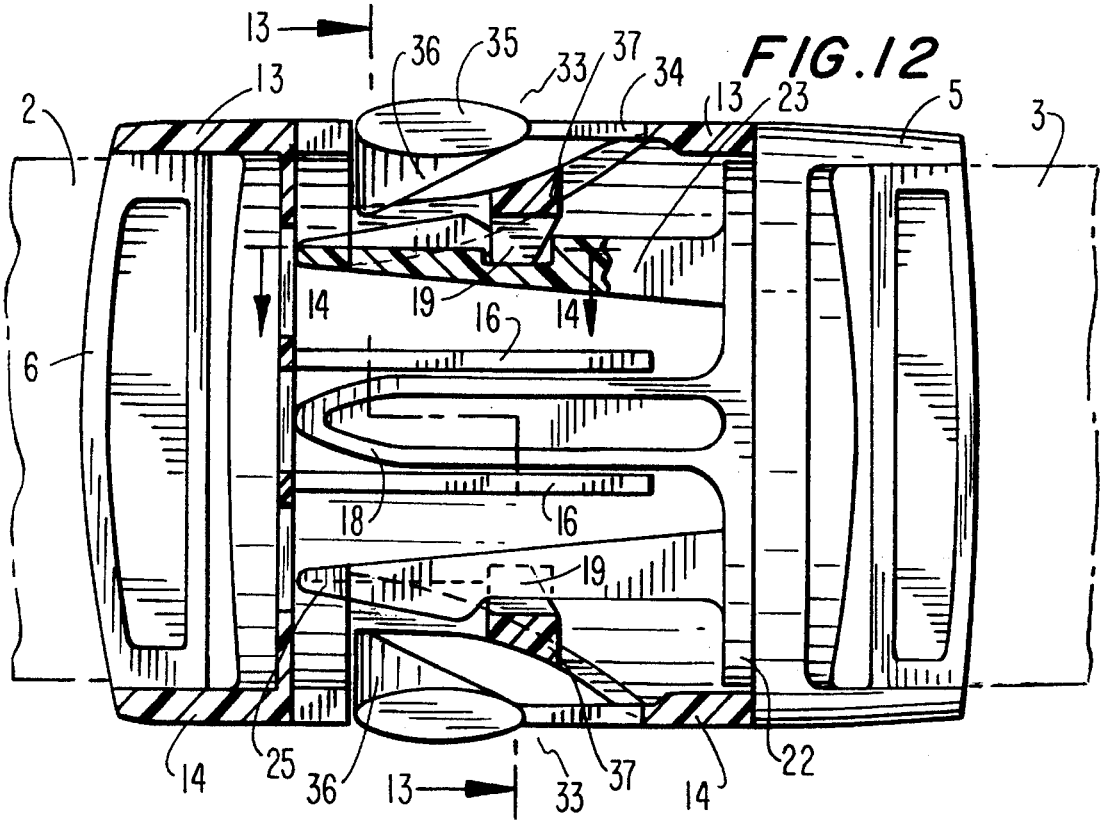
FIG. 12 is a bottom cross-sectional view of the buckle illustrated in FIG. 11 taken along the line 12—12.
Figure 14:
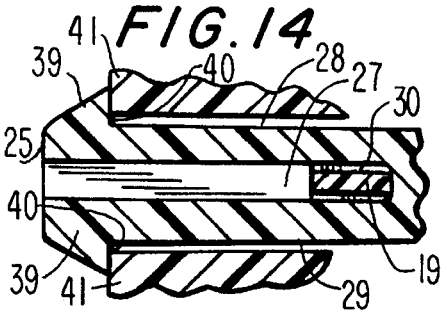
FIG. 14 is a side isolated cross-sectional view of the locking mechanism of the buckle illustrated in FIG. 11.

To releasably connect the male plug member 5 to the female socket member 4, the distal end 25 of each arm member 23 is first inserted within the cavity 10 through the opening in the distal end of the socket member 4. Upon continued insertion, the distal ends 25 and grooves 27 will contact the ramped surfaces 21 of each tooth 19, and each arm member 23 will be flexed toward the interior of cavity 10. Further insertion causes the ramped surfaces 21 to ride along the grooves 27 until the notch 30 receives the tooth 19. At this point, each arm member 23 snaps outward with respect to the cavity 10 and, as FIGS. 12 and 14 illustrate, the shoulder defined by the notch 30 is seated against the locking surface 20 of tooth 19. At this point, the finger 36 of each releasing member 33 just rests against each arm member 23, or rests only a very short distance from the arm member as depicted in FIG. 12.

Figure 15:
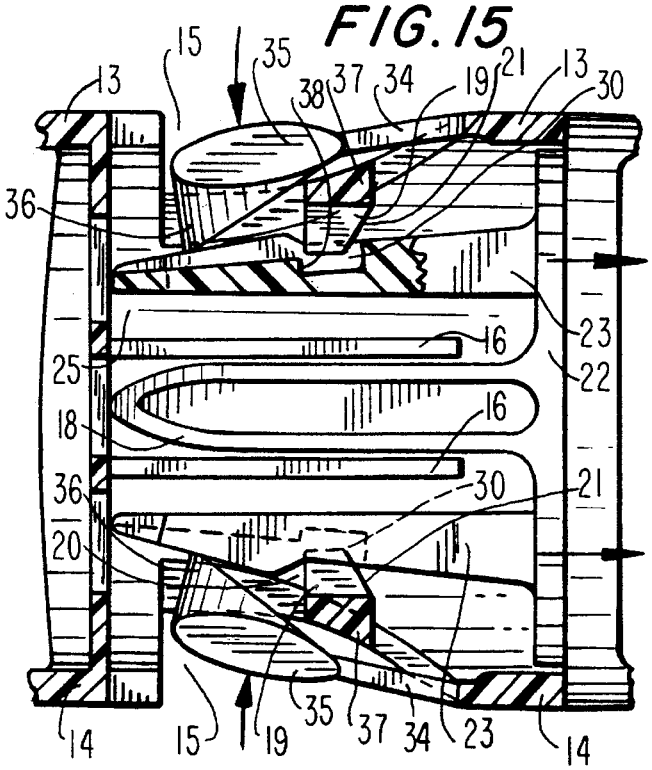
FIG. 15 is an isolated bottom cross-sectional view of the buckle of FIG. 12 showing disengagement or release of the locking mechanism.

As FIG. 15 illustrates, to release the male plug member 5 from the socket member 4, the user simply squeezes the heads 35 of the opposing releasing members 33 toward the interior of cavity 10. This causes each finger 36 to engage each arm member 23 to cause the arm members 23 to flex inwardly toward the center of cavity 10. Eventually, the shoulders 38 defined by notches 30 will clear the locking surfaces 20 of teeth 19 thereby freeing the arm members 23 from teeth 19. The resilient force now exerted by the inwardly flexed arm members 23, in cooperation with the ramped surfaces 21, will urge the plug member 5 to spring out of the cavity 10.

As in the first embodiment, since the grooves 27 are disposed along the midway line between the top and bottom surfaces 28 and 29 of the arm members 23, and since the shoulders defined by the notches 30 extend toward the central longitudinal axis of the arm members 23, the engagement or retaining force provided by engagement of the notches 30 with the teeth 19 runs through the central longitudinal axis of each arm member 23 and is aligned with the load force tending to separate the coupled buckle pieces.

Figure 11:
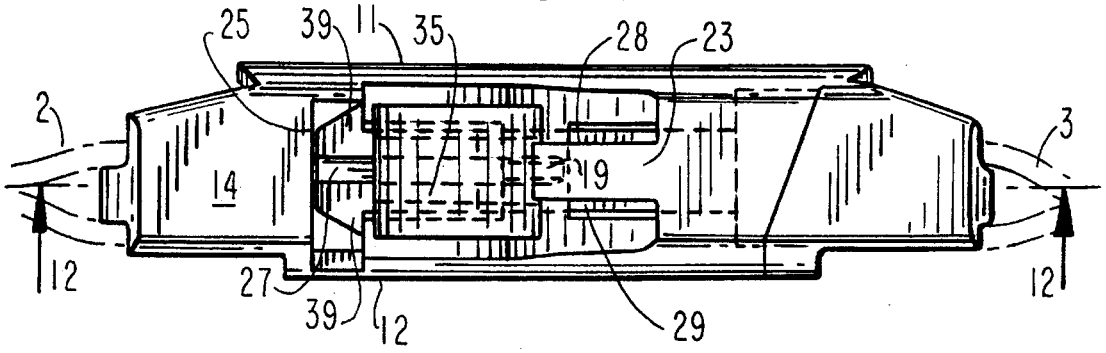
FIG. 11 is a side elevational view of the buckle of FIG. 10 in the coupled or locked state which is partially broken away to expose the engaged locking mechanism.
Figure 13:
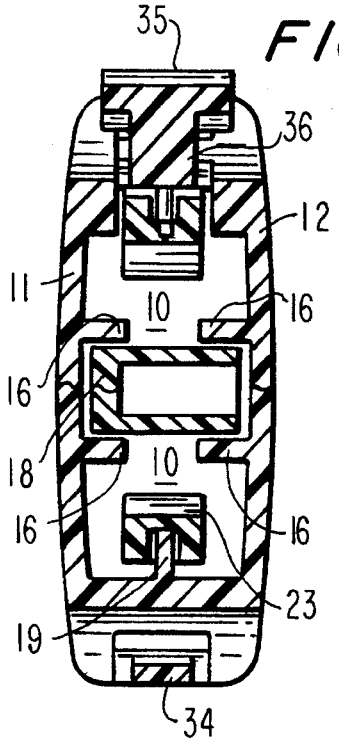
FIG. 13 is a staggered cross-sectional view of the buckle illustrated in FIG. 12 taken along the staggered line 13—13.

In addition to the stop member provided by shoulder 38 in notch 30, each arm member 23 may have a pair of wings 39 at the distal end 25 thereof (see FIGS. 11 and 14). The wings 39 define shoulders 40 on the proximal face thereof, the shoulders 40 being situated on opposite top and bottom sides of the arms 23. The shoulders are adapted to abut against retaining members 41 which project from the inner surfaces of the top 11 and bottom 12 walls of the socket member 4 to lock the plug member 4 in the socket. To disengage this locking mechanism, the heads 35 of the releasing members are squeezed inwardly toward the center of cavity 10 to force the wings 39 clear of the retaining members 41. The structure and operation of this optional additional locking mechanism is described more fully in my copending application Ser. No. 08/286,610 filed on Aug. 5, 1994 which is incorporated herein by reference.

In the preceding specification, the invention has been described with reference to specific exemplary embodiments thereof. It will, however, be evident that various modifications and changes may be made thereunto without departing from the broader spirit and scope of the invention as set forth in the claims which follow. The specification and drawings are accordingly to be regarded in an illustrative rather than a restrictive sense.

What is claimed is:

1. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having at least one arm member for insertion within said cavity of said socket member through said open end of said cavity, said at least one arm member having a top surface, a bottom surface, an outer side surface and an inner side surface;

a notch cut into the outer side surface of said at least one arm member, said notch defining a locking shoulder in said arm member, and said shoulder being positioned along a longitudinal axis disposed midway between said top surface and said bottom surface of said at least one arm member;

an engagement member projecting from an inner surface of at least one of said side walls of said socket member, the engagement member being disposed on a midway line between said top wall and said bottom wall and said engagement member being adapted to mate with said notch on said at least one arm member when said at least one arm member is inserted into the open end of said cavity to couple the plug member to the socket member;

a groove extending from a distal end of said at least one arm member to said notch, said groove being adapted and positioned to slidably receive said engagement member when said at least one arm member is inserted into said socket member to couple the plug member to the socket member;

means for disengaging the notch from the engagement member to permit decoupling of the plug member from the socket member; and means for coupling a belt to at least one of the plug member or the socket member.

2. The buckle according to claim 1 wherein said at least one arm member has a predetermined thickness between its outer side surface and its inner side surface, and wherein said shoulder extends through a longitudinal axis situated midway between said outer side surface and said inner side surface.

3. The buckle according to claim 2 wherein the means for disengaging includes a rounded protrusion along the outer side surface of said at least one arm member and an aperture defined in said at least one of said side walls of said socket member, whereby said rounded protrusion is exposed through said aperture when said plug member is coupled to said socket member.

4. The buckle according to claim 2 wherein said means for disengaging comprises a pivotable member which is coupled to the socket member, and which is adapted to be pivoted from said at least one of said side walls of the socket member toward the interior of said cavity to force said at least one arm member to flex inwardly to free said notch from said engagement member and permit decoupling of the plug member from the socket member.

5. The buckle according to claim 2 further comprising a groove extending from a distal end of said at least one arm member to said notch, said groove being adapted and positioned to slidably receive said engagement member when said at least one arm member is inserted into said socket member to couple the plug member to the socket member.

6. The buckle according to claim 2 wherein said engagement member is a tooth having a ramped surface and a locking surface, said locking surface being adapted to abut against said shoulder when said plug member is coupled to said socket member.

7. The buckle according to claim 1 wherein the means for disengaging includes a rounded protrusion along the outer side surface of said at least one arm member and an aperture defined in said at least one of said side walls of said socket member, whereby said rounded protrusion is exposed through said aperture when said plug member is coupled to said socket member.

8. The buckle according to claim 1 wherein said means for disengaging comprises a pivotable member which is coupled to the socket member, and which is adapted to be pivoted from said at least one of said side walls of the socket member toward the interior of said cavity to force said at least one arm member to flex inwardly to free said notch from said engagement member and permit decoupling of the plug member from the socket member.

9. The buckle according to claim 8 wherein the pivotable member includes a stem portion which is pivotably attached to said at least one of said side walls of the socket member and a head region, the head region including a inwardly projecting finger which is adapted to engage said at least one arm member for decoupling the plug member from the socket member.

10. The buckle according to claim 8 wherein the pivotable member is pivotable through an opening in said at least one of said side walls.

11. The buckle according to claim 10 wherein said at least one side wall which has an opening further includes a bridge from the top wall to the bottom wall across said opening, and wherein said engagement member projects from said bridge.

12. The buckle according to claim 1 further comprising a groove extending from a distal end of said at least one arm member to said notch, said groove being adapted and positioned to slidably receive said engagement member when said at least one arm member is inserted into said socket member to couple the plug member to the socket member.

13. The buckle according to claim 1 wherein said engagement member is a tooth having a ramped surface and a locking surface, said locking surface being adapted to abut against said shoulder when said plug member is coupled to said socket member.

14. The buckle according to claim 1 further comprising a second shoulder which is defined along said outer side surface of said at least one arm member, said second shoulder extending from said top surface to said bottom surface, and wherein the socket member further includes a stop member which is adapted to engage said shoulder when the plug member is coupled to the socket member to lock the plug member to the socket member.

15. The buckle according to claim 1 having two arm members, each arm member running along opposite sides of the plug member.

16. The buckle according to claim 15 having two arm members, each arm member running along opposite sides of the plug member.

17. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having at least one arm member for insertion within said cavity of said socket member through said open end of said cavity, said at least one arm member having a top surface, a bottom surface, an outer side surface and an inner side surface;

a notch cut into the outer side surface of said at least one arm member, said notch defining a locking shoulder in said arm member, and said shoulder being positioned along a longitudinal axis disposed midway between said top surface and said bottom surface of said at least one arm member;

an engagement member projecting from an inner surface of at least one of said side walls of said socket member, the engagement member being disposed on a midway line between said top wall and said bottom wall and said engagement member being adapted to mate with said notch on said at least one arm member when said at least one arm member is inserted into the open end of said cavity to couple the plug member to the socket member;

means for disengaging the notch from the engagement member to permit decoupling of the plug member from the socket member, the means for disengaging comprising a pivotable member which is coupled to the socket member, and which is adapted to be pivoted from said at least one of said side walls of the socket member through an opening in the side wall toward the interior of said cavity to force said at least one arm member to flex inwardly to free said notch from said engagement member and permit decoupling of the plug member from the socket member;

a bridge from the top wall to the bottom wall across said opening in said at least one side wall, wherein said engagement member projects from said bridge; and means for coupling a belt to at least one of the plug member or the socket member.

18. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having at least one arm member for insertion within said cavity of said socket member through said open end of said cavity, said at least one arm member having a top surface, a bottom surface, an outer side surface and an inner side surface;

a notch cut into the outer side surface of said at least one arm member, said notch defining a locking shoulder in said arm member, and said shoulder being positioned along a longitudinal axis disposed midway between said top surface and said bottom surface of said at least one arm member;

an engagement member projecting from an inner surface of at least one of said side walls of said socket member, the engagement member being disposed on a midway line between said hop wall and said bottom wall and said engagement member being adapted to mate with said notch on said at least one arm member when said at least one arm member is inserted into the open end of said cavity to couple the plug member to the socket member;

a second shoulder which is defined along said outer side surface of said at least one arm member, said second shoulder extending from said top surface to said bottom surface, and wherein the socket member further includes a stop member which is adapted to engage said shoulder when the plug member is coupled to the socket member to lock the plug member to the socket member;

means for disengaging the notch from the engagement member and for disengaging the second shoulder from the stop member to permit decoupling of the plug member from the socket member; and means for coupling a belt to at least one of the plug member or the socket member.

19. A side release buckle, comprising:

a female socket member comprising a top wall, a bottom wall and a pair of opposing side walls connecting the top and bottom walls, the side walls and the top and bottom walls defining a cavity therebetween which is open at an open end thereof;

a male plug member having at least one arm member for insertion within said cavity of said socket member through said open end of said cavity, said at least one arm member having a top surface, a bottom surface, an outer side surface and an inner side surface;

a notch cut into the outer side surface of said at least one arm member, said notch defining a locking shoulder in said arm member, and said shoulder being positioned along a longitudinal axis disposed midway between said top surface and said bottom surface of said at least one arm member;

an engagement member projecting from an inner surface of at least one of said side walls of said socket member, the engagement member being disposed on a midway line between said top wall and said bottom wall and said engagement member being adapted to mate with said notch on said at least one arm member when said at least one arm member is inserted into the open end of said cavity to couple the plug member to the socket member;

means for disengaging the notch from the engagement member to permit decoupling of the plug member from the socket member; and means for coupling a belt to at least one of the plug member or the socket member, wherein said at least one arm member has a predetermined thickness between its outer side surface and its inner side surface, and wherein said shoulder extends through a longitudinal axis situated midway between said outer side surface and said inner side surface, and said engagement member extends through said longitudinal axis situated midway between the outer side surface and the inner side surface when the plug member is coupled to the socket member.

* * * * *